United States Patent [19]

Bolling

[11] Patent Number: 4,570,824

[45] Date of Patent: Feb. 18, 1986

[54] DOORBELL ACTUATED AIR FRESHENER

[76] Inventor: Yvonne Bolling, 3833 Mercer La., Harvey, La. 70058

[21] Appl. No.: 531,501

[22] Filed: Sep. 12, 1983

[51] Int. Cl.[4] ..... B67D 5/32

[52] U.S. Cl. ..... 222/39; 222/180; 222/333; 222/504; 239/274

[58] Field of Search ..... 222/52, 61, 63, 173, 222/180, 181, 645, 646, 649, 333, 394, 402.1, 504, 192, 39; 100/73; 340/393, 407; 239/274; 116/2

[56] References Cited

U.S. PATENT DOCUMENTS 2,136,647 11/1938 Stevenson ..... 340/407
3,195,777 7/1965 Hart ..... 222/181 X
3,411,670 11/1968 Mangel ..... 222/649
4,365,238 12/1982 Kollin ..... 340/407 X

*Primary Examiner*—Joseph J. Rolla
*Assistant Examiner*—Michael S. Huppert
*Attorney, Agent, or Firm*—Keaty & Keaty .

[57] ABSTRACT

An improved air freshener dispenser is activated by the signal transmitted along a home doorbell actuation line. The air freshener is located at a convenient location for spraying an amount of an aerosol air freshener into an entry or desired public area of a home or house. The actuation mechanism is connected to the doorbell system for the house. In operation a guest, or other person entering the home, will in practice ring the doorbell releasing a metered amount of the aerosol air freshener which will have had time to disburse throughout the area concerned at approximately the time the guest enters.

4 Claims, 3 Drawing Figures

DOORBELL ACTUATED AIR FRESHENER

BACKGROUND OF THE INVENTION

This invention relates to the control of odors within a home or a house and to a new and novel means of timing and actuating the disbursing of an air freshener so as to provide the maximum effective freshening of a scent or perceived odors within a house at a minimum cost and use of air freshener.

It is widely known that enclosed spaces, especially homes in which many activities take place, have a tendency to gather distinctive odors, some of which may be unpleasant. It is also a known physiological fact that the human sensory apparatus adapts to the environment in which it is located. Thus persons who have been in an area for a certain period of time, unless the odor is particularly foul, will not notice any odors in that area; their noses have adapted to the environment in which they sit. A person entering the area for the first time, such as a guest and the like, will instantly notice odors that the inhabitants have masked out.

The recent emphasis in home construction upon energy efficient homes and upon environmental and energy savings have resulted in the construction of nearly airtight homes; very little air circulation now occurs between the inside and the outside of the house, especially in a house of new construction. As a result, the collection and holding of normal household odors is magnified in new construction housing and the sensory impact upon a person entering the house for the first time can be severe. As a result, a number of odor masking or odor dampening aerosol sprays of commercial design had been developed.

These sprays, in general, are in the form of pressurized aerosol can dispensensers. The pressurized can contains a liquid form of the air freshener under a gas pressure. The can is also provided with a mechanically displaceable spray valve and spray head, normally of a unitized plastic construction approximating that of a pushbutton, which serves the twin functions of releasing the liquid and forming it into an aerosol spray.

It is of course extremely inconvenient, and highly unlikely, that a person in the household will keep a can of such spray at all times for periodic spraying in the air whenever a guest or the like arrives. Thus a number of inventions and prior developments in this art have concentrated on the providing of a mechanically timed air freshener release. These air freshener releases are in the form of can holders which will take a standard aerosol can together with an electric motor actuated cam operated button depressor mechanism which periodically depresses the spray head on the aerosol can causing it to emit the spray through a hole. It should be obvious that this type of timed device utilizes a constant expenditure of air freshener and is essentially independent of the arrival of guests or other persons entering the house from the outside.

The effect of such timed releases is in fact the opposite of that which is often intended. The human sensory apparatus reacts to changes in the odor patterns much more strongly than the consistent monitoring of an existing odor. Since it is highly unlikely that at any spray of the timed air freshener a guest has entered the room, what is more likely is that the inhabitants who have become used to the normal room environment are instead being exposed to periodic pulses of a scented air freshener. This can produce a cloying effect as of being exposed to too much of a sweet or perfumed odor and can over time become an offensive an effect as the room odors would be to one entering from the outside.

For this reason, a separate development in the art of air freshener dispensers has concentrated on developing air freshener can holders which are mechanically actuated by the opening of a door when a person enters a room. Two major problems exist with this particular development.

The first, which has been noted in the art and is the subject of several developments in an attempt to overcome, results from the requirement that such a device must be mounted on or adjacent to a door so that it may be actuated by the opening and closing of the door. It happens that the standard sizes and shapes of doors commonly in use in American households is such that the typical mounting for such an air freshener is at face height or a little above face height. This can result, especially in the situation where one person opens a door from one side to admit a second person from a second side, in one of the two people being sprayed almost directly in the face by the air freshener.

A second problem is that the spray occurs simultaneously with the opening of the door. An air freshener is most effective when it has been sprayed and has been given a short period of time within which to disperse within the air within a room. Both its odor masking and odor absorbing or odor neutralizing properties will then have had time to take maximum effect. By comparison, an immediate spray of an air freshener without time to disperse will produce more of a concentrated perfume effect without actually freshening or eliminating the perceived odors within the room.

SUMMARY OF THE INVENTION

It is the object of this invention to provide a mechanically actuated air freshener dispersing means for use in the home which more clearly and correctly dispenses the air freshener for use when it is most needed.

As discussed above, the most needed time for air freshening within a closed home, especially a home of the environmentally sealed variety, is immediately prior to the entry of someone from the outside. Such a guest is not acclimatized to the environment in the house and most sharply notices any odor patterns or smells within the home. By the same token, it is necessary or desirable that this air freshener be dispersed a short period of time prior to the actual entry of the guests, short in this case being a matter of a few seconds but less than a minute.

It is thus desirable to have an actuating means which is sensitive to a guest's arrival in such a manner that the guest's actual entry into the house area or living area may be anticipated by a number of seconds permitting the dispersal of an air freshener burst.

This invention meets these requirements by its use of an almost universal signal system available in nearly American household for detecting and announcing the arrival of a guest or outsider. This detection system is the doorbell; doorbells are found installed on nearly every American home and are universal on houses of the now common environmentally sealed, construction.

In each case, the doorbell mechanism consists of buttons located conveniently to every major entrance to the house, coupled with a transformer mechanism for stepping the signal voltage down to a safe level and periodically placed annunciators for signaling persons in the house of the arrival of a visitor. Because the annunciators must be heard to be effective, they are located in the public areas of the house where the inhabitants will be most often found, and where, likewise, the guests will be most often brought.

It is the essence of this invention therefore that an electrically actuated air freshener disperser is intercoupled to the doorbell system in the house such that the actuation of the doorbell will provide a metered burst of air freshener into the public areas of the house where the guest is likely to enter. The normal time delay between the actuation of the doorbell and the actual admission of the guest is ideal for the proper disbursing of the air freshener into the atmosphere thus avoiding the cloying perfumed evidence of air freshening and providing the maximum odor masking and odor neutralizing effect.

In addition, the invention uses existing wiring ubiquitous to American homes thus requiring extremely little modification to the house and permitting fairly wide flexibility in the installation of the air freshener. The air freshener dispenser mechanism itself can be located so that there is little danger that a spray of air freshener will strike a person in the face yet, because doorbell signals are provided in public entry areas, there will be an ideal location where the doorbell actuation signal is available in every house for the installation of the air freshener.

Further, because doorbells utilize deliberately stepped down safe voltages for their operation and are typically isolated by doorbell transformer from main house power, the installation of the doorbell freshener is extremely safe as there are no dangerous voltages present on the freshener. This is particularly important as this is an appliance which requires the periodic opening, removal, and replacement of the aerosol can of air freshener.

Further, because the air freshener dispersant is metered and restricted to those times when an atual guest arrives as evidenced by the actuation of the doorbell, a minimum expenditure of air freshener is made for maximum effect. This system is extremely economical of air freshener expenditures and of course avoids the ineffectiveness and annoyance problems of the timed air freshener dispersants.

It is thus an object of this invention to provide an air freshener disperser which provides the most effective timed dispersal of an air freshener within a home immediately prior to the entry thereunto by a guest or person from the outside.

It is a further object of this invention to provide an air freshener disperser which makes most effective use of a can of air freshener without wasting the same.

It is a further object of this invention to provide an air freshener disperser which uses standard aerosol cans of air freshener which are commonly available upon the market to a homeowner.

It is a further object of this invention to provide an air freshener disperser which detects the arrival of a guest sufficiently prior to the actual entry of the guest to allow proper dispersal of the air freshener within the atmosphere within the home.

These and other objects of this invention are met as described hereinafter in the detailed description of the preferred embodiment of the invention.

DETAILED DESCRIPTION OF THE PREFERRED EMBODIMENT

Figure 1:
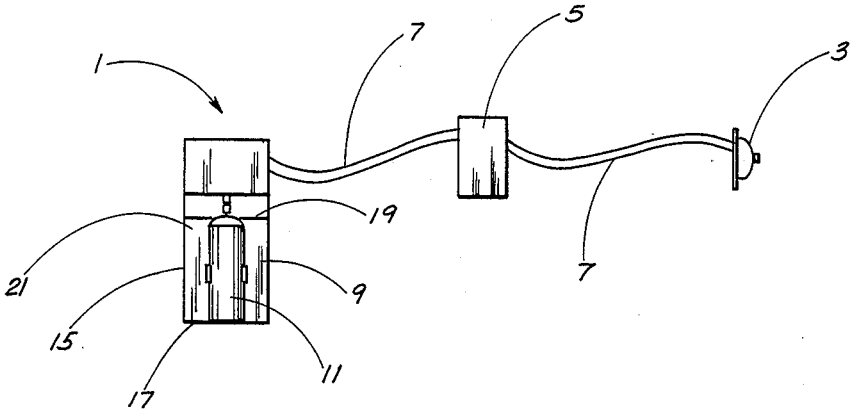
FIG. 1 is a schematic view of an operating system of the apparatus of the present invention.
Figure 2:
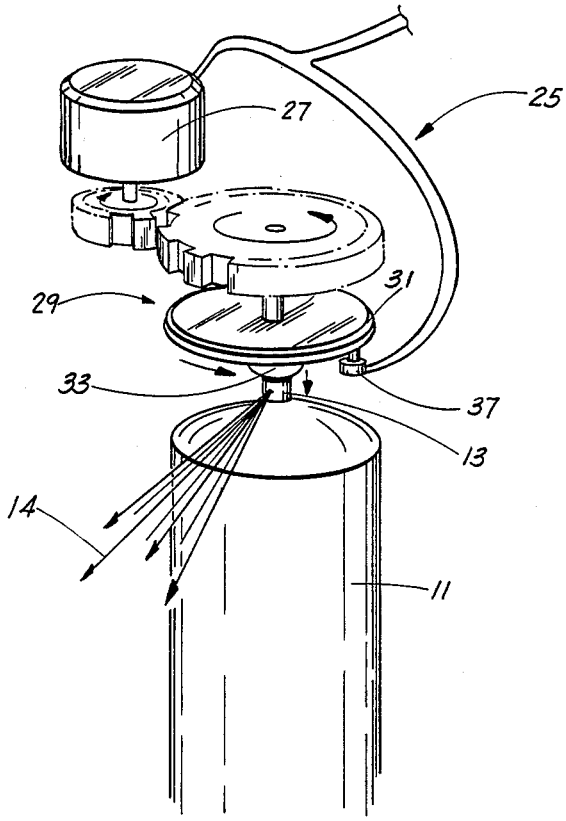
FIG. 2 is a perspective view of the apparatus of the present invention.
Figure 3:
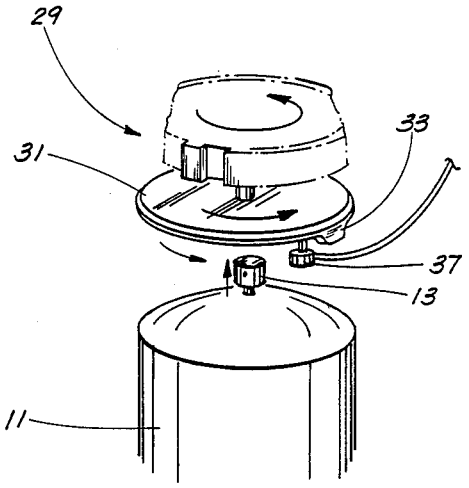
FIG. 3 is a perspective view of the cam-pusher and timing means of the apparatus of the present invention.

Referring now to FIG. 1 the overall invention is shown in general form comprising three major subassemblies in combination; the typial doorbell pushbutton 3 found on the exterior of the average home at each of the entry doors thereto; innerconnected by electrical means to a doorbell transformer 5 which provides safe electrical power to the entire doorbell system; the innerconnection means being control wiring 7, which then extends to air freshener disperser 9, which is connected in parallel with or in lieu of, a standard doorbell annunciator, not shown.

The air freshener disperser 9 itself is primarily a means for holding and actuating an air freshener aerosol can 11, which is of standard design, available commercially in supermarkets and the like. The air freshener aerosol can 11 has located centered at its top, an aerosol push button 13 which provides a directed aerosol spray 14 of air freshener upon being depressed a measured distance.

Within the air freshener disperser 9 the air freshener aerosol can 11 is held within a retention frame 15. In its simplest form, the retention frame 15 comprises a bottom plate 17 substantially holding the air freshener aerosol can 13 against its weight and also against downward forces imposed as will be described later upon the aerosol pushbutton 13. A retention shoulder or shoulders 19 is optionally provided for clamping the aerosol can 11 against a vertical movement for any reason. A aerosol can 11 firmly within the air freshener disperser 9 but by means of being an opening and closing closure, permits the ready removal and replacement of the aerosol can 11 upon depletion or for any other reason.

As noted above, the aerosol pushbutton 13 generates, when depressed, a directed aerosol spray 14 of air freshener. A passage or aerosol opening 23 is therefore provided within the air freshener disperser to permit this aerosol spray 14 unimpeded travel into the air within a room.

Within the air freshener disperser 9 the aerosol can 11 is in fact actuated by actuation means 25. The only essential requirement on actuation means 25 is that it must provide a downward mechanical force upon the aerosol pushbutton 13 for a period of time while the doorbell is being pressed and must then release the force upon release of the doorbell after having sprayed air freshener from the aerosol can 11.

In the preferred embodiment of the invention the actuation means 25 further comprises an electric motor 27 of the type adapted to the signal power being provided by control wiring 7. The electric motor in turn actuates a cam pusher 29 for actuation of the pushbutton 13. The cam pusher 29 comprises in essence a rotating cam 31 driven by the electric motor either directly or through gearing, not shown. The rotating cam 31 in turn through an opposing cam follower means 33 which translates the inward and outward motion generated by the rotating cam into a push action directly, contactingly driving the aerosol pushbutton 13 in a periodically depressed direction. Since, as is true for any cam mechanism using a rotating drive means, the cam must travel through a complete cycle for each actuation, there is also the requirement for timing means 37, in the preferred embodiment a cam driven switch, to insure that the electric motor rotates a sufficient amount to actuate and release upon each application of power. This insures that the cam both actuates and releases the aerosol pushbutton 13.

It is equally obvious that an electric motor driven cam is not necessary. In this particular invention it is equally possible to use a solenoid pusher, not shown, of standard design as known in the art. It is a particular characteristic of this invention that the actuation means, the doorbell 3, and its associated control wiring 7, provides a measured on/off signal due to the nature of the actuation of doorbells and the fact that the user depresses the doorbell button for a period of time. Thus it is not necessary to have timing means 37 for all actuating means 25 as an appropriate metered amount of air freshener can be released by the expected normal human actuation of the doorbell button 3. For this reason, the actuation means 25 is not restricted to those metered actuators utilizing electric motors 27 and cams 29 as are commonly found in the art for timed, electrically powered air freshener dispensers; it is equally possible to use a solenoid push means as is known to the art but as is uncommonly used because of the difficulty of providing a measured signal to the solenoid. It can readily be seen that this invention overcomes this singular disadvantage and thus allows the use of a wider range of electrically driven air freshener dispersers 9.

In operation, the air freshener disperser 9 having been loaded with an air freshener aerosol can 11 by means of opening the front closure 21, placing the aerosol can 11 bottom against the bottom plate 17, optionally pushing the can in to be held by the optional retention shoulders 19, then closing the front closure 21. The aerosol can 11 must be oriented, of course, so that the directed spray 14 as created by the aerosol pushbutton 13 is aimed through the provided aerosol opening 23. When a guest, or other person having been outside the home and not acclimated to the home approaches, they will signal their presence and request entrance by pushing doorbell button 3 found adjacent to the entrance to the home. Actuation of doorbell button 3, as is commonly known to the art of doorbell signaling means, induces an electric current through doorbell transformer 5 which is propagated throughout control wiring 7 to the annunciators, not shown, attached to the control wiring 7 and also the air freshener disperser 9 attached to the control wiring 7. Application of this electrical power to the air freshener disperser 9 triggers the actuation means 25. In the preferred embodiment it causes electric motor 27 to turn turning rotating cam 31 which drives opposing spring cam follower 33 in a direction against the aerosol push button 13 found on the top of the air freshener aerosol can 11 causing the aerosol push button 13 to emit an aerosol spray 14 of air freshener through the aerosol opening 23 provided in the air freshener disperser 9 and thence into the room of the house where it mixes and disberses with the air masking and neutralizing the odors found in the room. The timing means 37 continues the operation of electric motor 27 until the rotating cam 31 returns to substantially a rest position causing the cam follower 33 to withdraw from the aerosol push button 13 releasing the aerosol push button 13 and ceasing the spray 14 of aerosol therefrom.

Some small time after the actuation of the doorbell, the inhabitants will open the entry door and admit the guests. By this time the aerosol will have thoroughly dispersed within the public area concerned, and will have reached maximum effectiveness in both masking and neutralizing the odors. The guest therefore is met not with the expected smells of a sealed household, but with a pleasant fresh odor as was desired.

It can be seen from the description of the preferred embodiment of the invention that the invention is not restricted to the specific design of the air freshener disperser stated but rather admits of a wide range of equivalent air freshener dispersers interconnected with the doorbell system and doorbell control means within an average home. Thus the invention should not be limited to that which has been described above but rather as stated in the claims below.

What is claimed as invention is:

1. An apparatus for dispensing a metered amount of aerosol of air freshener from an aerosol can into a room responsive to actuation of a house door bell, comprising:

an electrically operated aerosol can actuation means;

means for electrically connecting the doorbell to the aerosol can actuation means;

means for mounting the aerosol can and the aerosol can actuation means on the wall in the room.

2. The apparatus as described in claim 1 above wherein said means for mounting the aerosol can and the aerosol can actuation means further comprises:

a frame retention means retaining the aerosol can in a fixed relationship to said actuation means.

3. The apparatus of claim 1 above, wherein the actuation means further comprises:

an electric motor electrically connected to the doorbell wiring;

cam means rotatably connected to the electric motor;

an opposing cam follower means attached to the cam means for transmitting a depressing force on the pushbutton of the aerosol can responsive to actuation of the doorbell.

4. The apparatus as described in claim 1 above, wherein the actuation means further comprises:

an electric solenoid having an actuated and a nonactuated position, electrically connected to the control wiring;

said solenoid being mechanically connected to the aerosol can pushbutton such that the actuated solenoid position corresponds to a depressed, aerosol emitting position of the aerosol can push button; and the non actuated position of the solenoid corresponds to the raised, aerosol non emitting position of the aerosol can push button.

* * * * *